US012139175B2

(12) United States Patent
Enrich Tudela et al.

(10) Patent No.: US 12,139,175 B2
(45) Date of Patent: Nov. 12, 2024

(54) SYSTEM AND METHOD FOR HARMONISING THE OPERATING STATUS OF PAIRS OF DOORS FORMED BY A TRAIN DOOR AND A PLATFORM DOOR

(71) Applicant: MASATS, S.A., Sant Salvador de Guardiola (ES)

(72) Inventors: Joan Enrich Tudela, Vilassar de Dalt (ES); Polycarpos Karatzas, Sant Cugat del Valles (ES); Francisco Vazquez Gallego, Viladecans (ES); Selva Vía Labrada, Barcelona (ES); David Calero Scanlan, Cervello (ES); Jesús Alonso Zarate, Castelldefels (ES)

(73) Assignee: MASATS, S.A., Sant Salvador de Guardiola (ES)

( * ) Notice: Subject to any disclaimer, the term of this patent is extended or adjusted under 35 U.S.C. 154(b) by 970 days.

(21) Appl. No.: 17/260,816

(22) PCT Filed: Jul. 10, 2019

(86) PCT No.: PCT/ES2019/070481
§ 371 (c)(1),
(2) Date: Jan. 15, 2021

(87) PCT Pub. No.: WO2020/016470
PCT Pub. Date: Jan. 23, 2020

(65) Prior Publication Data

US 2021/0293076 A1 Sep. 23, 2021

(30) Foreign Application Priority Data

Jul. 19, 2018 (EP) ..... 18382541

(51) Int. Cl.
*B61B 1/02* (2006.01)
*B61D 19/00* (2006.01)

(52) U.S. Cl.
CPC ..... *B61B 1/02* (2013.01); *B61D 19/003* (2013.01)

(58) Field of Classification Search
CPC ..... B61B 1/02; B61B 1/00; B61D 19/003
See application file for complete search history.

(56) References Cited

U.S. PATENT DOCUMENTS 4,551,944 A 11/1985 Donaldson
2011/0184621 A1* 7/2011 Bock ..... B61L 15/0062 701/70

(Continued)

FOREIGN PATENT DOCUMENTS

CN 1814485 A 8/2006
DE 10 2009044 843 A1 6/2011

OTHER PUBLICATIONS

European Search Report for EP 18 38 2541 dated Jan. 23, 2019.

(Continued)

*Primary Examiner* — Hunter B Lonsberry
*Assistant Examiner* — Henry R Hinton
(74) *Attorney, Agent, or Firm* — Sughrue Mion, PLLC

(57) ABSTRACT

The system and method of the present invention enables the harmonisation of the operating status of pairs of train and platform doors, enables both doors to be actuated simultaneously or be disabled or isolated if one of them has been disabled or isolated by means of door isolating means and also enables the harmonisation of the opening actuation of the pair of doors by the user using door-opening request devices.

11 Claims, 7 Drawing Sheets

(56) References Cited

U.S. PATENT DOCUMENTS

2016/0059874 A1* 3/2016 Miyajima ..... B61L 25/025
246/127
2016/0207546 A1* 7/2016 Komura ..... B61L 27/40

OTHER PUBLICATIONS

International Search Report for PCT/ES2019/070481 dated Nov. 8, 2019 (PCT/ISA/210).
Written Opinion for PCT/ES2019/070481 dated Nov. 8, 2019 (PCT/ISA/237).

* cited by examiner (CURRENT STATE OF THE ART)

SYSTEM AND METHOD FOR HARMONISING THE OPERATING STATUS OF PAIRS OF DOORS FORMED BY A TRAIN DOOR AND A PLATFORM DOOR

CROSS REFERENCE TO RELATED APPLICATIONS

This application is a National Stage of International Application No. PCT/ES2019/070481 filed Jul. 10, 2019, claiming priority based on European Patent Application No. 18382541.3 filed Jul. 19, 2018.

TECHNICAL FIELD OF THE INVENTION

The system and method of the present invention enables the harmonisation of the operating status of pairs of doors formed by a train door mounted on a train and a platform door mounted on a platform, such that both doors can be actuated simultaneously or be disabled if either of them has been disabled or isolated by means of door isolating means. Furthermore, the system of the present invention enables the harmonisation of the opening actuation of the pair of doors by the user using door opening request devices.

BACKGROUND OF THE INVENTION

Systems are known for harmonising the operating status of pairs of doors formed by a train door mounted on a train and a platform door mounted on a platform, once the rail system has ensured that both doors are aligned when the strain stops at the platform. However, the known systems have certain drawbacks that make their implementation difficult.

In the known harmonisation systems, communication between pairs of doors is carried out by means of a centralised communication between the train and the platform that, due to the architecture of the system, entails accumulating a delay in the communication that is considered excessive for Mass Transit Systems, such that the implementation of the on-demand opening functionality, for example by means of the use of opening request devices or buttons, is not enabled.

In order to solve this problem, harmonisation systems by means of a distributed architecture and point-to-point communications between the doors, established through the control units of each of the doors, are also known. As both door systems, the train boarding door systems and the platform door systems, are independent systems and given that the harmonisation systems establish closed communications, the implementation thereof is not viable.

Another drawback of the known systems that enable the harmonisation of the operational status (enabled/disabled) of a pair of doors is that the architecture does not enable the communication to be established with enough time to give prior notice to the passenger of the non-operating status of the doors.

Therefore, an aim of the present invention is to disclose a system for harmonising the operational status and opening actuation of pairs of doors formed by a train door mounted on a train and a platform door mounted on a platform that harmonises the operating and non-operating status of the pair of doors, and at the same time immediately harmonises the opening of the pair of door when operational.

Another aim is to disclose a system that alerts passengers of the non-operating status of a pair of doors with sufficient notice to maximise the efficiency of the boarding and disembarkation of passengers.

Another aim is to disclose an alternative to the known harmonisation systems of the operating status of pairs of doors.

DESCRIPTION OF THE INVENTION

The system of the present invention enables the harmonisation of the operating status of pairs of doors formed by a train door mounted on a train and a platform door mounted on a platform, the paired doors being prepared to be aligned when the train stops at the platform. The train is provided with a train control unit, and the platform is provided with a platform control unit, prepared to send door opening signals and door enabling signals of the respective doors thereof. That is to say, the system comprising a train control unit adapted to be provided, it is, supplied, in the train, and a platform control unit adapted to be provided, it is, supplied, in the platform, the train control unit and the platform control unit being prepared to send door opening signals and door enabling signals of the respective doors thereof. Each door being linked to door opening request means, prepared to send a door opening request signal and door isolating means, prepared to send a door isolating signal; the train and platform doors also being connected to respective door control units prepared to receive an opening signal to open the door, an enabling signal to enable the door, and a isolating signal to isolate the door, thus disabling it, which trigger the opening of the door when the opening signal indicates opening the door, the enabling signal indicates enabling the door and the isolating signal indicates not disabling the door. That is to say, the system further comprising respective door control units being connectable to respective door control units prepared to receive an opening signal to open the door, an enabling signal to enable the door, and a isolating signal to isolate the door, thus disabling it, which trigger the opening of the door when the opening signal indicates opening the door, the enabling signal indicates enabling the door and the isolating signal indicates not disabling the door.

Essentially, the system is characterised in that it comprises at least one pair of adapter devices, one being connected between a train control unit and the respective door control unit, and the other being connected between the platform control unit and the respective door control unit, prepared to receive at least the door opening signal, the door opening request signal, and the door isolating signal; and exchange between the adapter devices of the pair of adapter devices at least one paired door opening notification signal after the receipt of a door opening signal or door opening request signal that indicates opening the door; and a paired door isolating notification signal after the receipt of a door isolating signal that indicates isolating the door; the adapter devices being prepared to trigger the harmonised opening of the paired doors by means of sending to the corresponding door control unit the opening signal to open the door and the enabling signal to enable the door, and/or the isolating signal to not isolate the door when at least one from among the door opening signal, the door opening request signal or the paired door opening notification signal indicates opening the door, and the door isolating signal and the paired door isolating notification signal indicate not isolating the door. In this way, the opening of both paired doors is advantageously achieved when one of them receives a door opening notification signal, both paired doors also being isolated, that is, unused, when at least one of them has received a door isolating signal. In the field of the invention, the term "harmonise" must be interpreted as ensuring that both paired doors are in the same operating status, that is, both are or are not isolated, and door opening status, that is, that both are or are not open; to summarise, they operate together. Naturally, this harmonisation system could also be used for any other mass transit system, such as trams or buses. It is also envisaged that the various units and devices of the system could be formed, each, by one or more physical or logical components, as required.

The paired door adapter devices are also provided with communication means to exchange paired door opening notification signals and paired door isolating notification signals. Naturally, although it is preferably envisaged that the door opening signal or door opening request signal shall indicate opening the door, the received door enabling signal shall indicate not enabling the door and the received door isolating signal shall indicate isolating the door, it is also considered in other embodiments that these signals are the negations thereof or other equivalent signals that, respectively, enable the same information to be indicated. Naturally, it is also envisaged that the signals exchanged by the adapter devices can directly be, among others, the received opening, enabling or isolating signals, suitably processing these signals to harmonise the opening and enabling of both paired doors.

In this way, it ensures that a pair of doors is out of service when at least one of the two doors is non-operational, that is, disabled or isolated, by means of the actuation of an isolating device in any of the doors of the pair of doors, such as a locking mechanism by the operator, and by means of an external communication system that is independent from the control units of each of the doors, further enabling the opening upon request of the pair of doors, when they are enabled, both by means of the actuation of a request device in any of the doors of the pair of doors, such as a button by the user, and by means of an external communication system that is independent to the control units of each of the doors, including when the external communication system only acts on one of the doors of the pair of doors.

Naturally, the way in which the different signals indicate opening or closing the door and enabling or disabling the door can be carried out and be encoded in several ways of those known in the state of the art. These statuses can be encoded, for example, by means of voltage levels, as well as rising or falling edges of pulses transmitted by means of signals, which determine one of the statuses corresponding to logic "1" and "0". Although it is envisaged that the adapter devices of the pair of adapter devices use the same types of signals, these can also use different types of signals, in this case having to appropriately configure the adapter devices for a correct operation.

In a variant of an embodiment, the adapter devices are prepared to combine the door opening signal and the door opening request signal, and send to the other device the paired door opening notification signal, that indicates opening the door when at least one of the door opening signal or door opening request signal indicates opening the door.

In a variant of an embodiment, the adapter devices are prepared to combine the door opening signal, the door opening request signal, and the paired door opening notification signal of the other adapter device to generate the opening signal that indicates, to the respective door control unit, opening the door when at least one of the door opening or paired door opening signals indicates opening the door.

In a variant of an embodiment, the communication means comprise point-to-point communication means between paired door adapter devices, enabling direct communication to be carried out independently between door adapter devices of the same pair of doors.

In a variant of an embodiment, the door opening request means comprise a button connected to an input of the adapter devices for generating the door opening request signal.

In a variant of an embodiment, the door isolating means comprise a locking mechanism connected to an input of the adapter devices to generate the door isolating signal.

In a variant of an embodiment, the system further comprises two connection nodes, one arranged on the train and the other on the platform, which centralise the status of the isolating means of the train and platform doors, respectively, both connection nodes being prepared to exchange the status of the isolating means of the train doors and the platform doors before the train arrives at the platform, and send an early isolating signal to the paired door adapter devices to isolate the door when the paired door isolating means indicate isolating the door.

It is also disclosed that the connection nodes are respectively arranged adjacent to ends of the train and platform.

A method for harmonising the operating status of pairs of doors formed by a train door mounted on a train and a platform door mounted on a platform is also disclosed, the paired doors being adapted to be aligned when the train stops at the platform, the train being provided with a train control unit, and the platform being provided with a platform control unit, prepared to send door opening signals and door enabling signals of the respective doors thereof; each door being linked to door opening request means, prepared to send a door opening request signal and door isolating means, prepared to send a door isolating signal; the train and platform doors being connected to respective door control units prepared to receive a door opening signal to open the door, an enabling signal to enable the door, and a isolating signal to isolate the door, thus disabling it, which trigger the opening of the door when the opening signal indicates opening the door, the enabling signal indicates enabling the door and the isolating signal indicates not disabling the door.

Essentially, the system is characterised in that it comprises the step of receiving in each adapter device of at least one pair of adapter devices, one being connected between a train control unit and the respective door control unit of the doors, and the other being connected between the platform control unit and the respective door control unit, at least the door opening signal, the door opening request signal, and the door isolating signal; and the step of exchanging between the adapter devices of the pair of adapter devices, by means of communication means at least one paired door opening notification signal after the receipt of a door opening signal or door opening request signal that indicates opening the door; and a paired door isolating notification signal after the receipt of a door isolating signal that indicates isolating the door; and the step of the adapter devices sending to the corresponding door control unit the opening signal to open the door and the enabling signal to enable the door, and/or the isolating signal to not isolate the door, to trigger the harmonised opening of the paired doors, when at least one from among the door opening signal, the door opening request signal or the paired door opening notification signal indicates opening the door, and the door isolating signal and the paired door isolating notification signal indicate not isolating the door.

In a variant of an embodiment of the method, the adapter devices carry out a step of combining the door opening signal and the door opening request signal, and sending to the other device the paired door opening notification signal, that indicates opening the door when at least one of the door opening signal or door opening request signal indicates opening the door.

In a variant of an embodiment of the method, the adapter devices carry out a step of combining the door opening signal, the door opening request signal, and the paired door opening notification signal of the other adapter device to generate the opening signal that indicates, to the respective door control unit, opening the door when at least one of the door opening signal or paired door opening signals indicates opening the door.

BRIEF DESCRIPTION OF THE DRAWINGS

As a complement to the description provided herein, and for the purpose of helping to make the characteristics of the invention more readily understandable, this specification is accompanied by a set of drawings which, by way of illustration and not limitation, represent the following.

DETAILED DESCRIPTION OF THE DRAWINGS

Figure 1A:
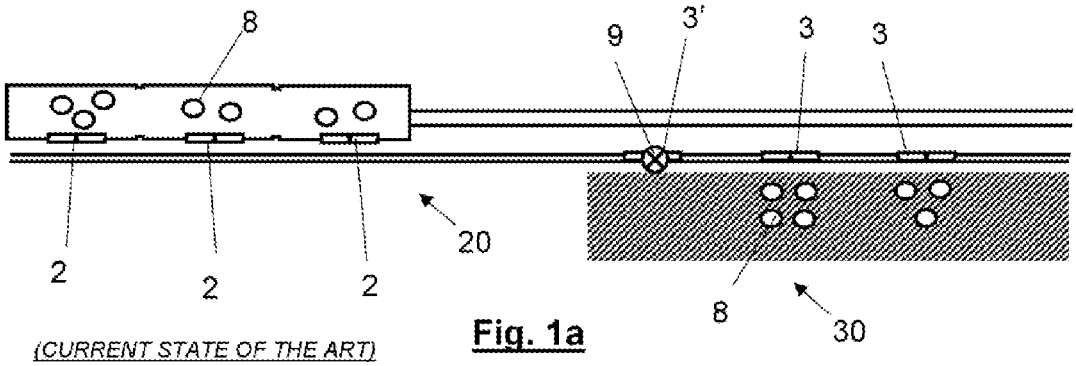
FIGS. 1*a* to 1*c* show a sequence of the arrival of a train at a platform, according to the state of the art without the door harmonisation system, which has a service fault of a door.

The known systems for harmonising the operating status of pairs of doors formed by a train door 2 mounted on a train 20 and a platform door 3 mounted on a platform, enable the train and platform doors, once the paired doors are aligned, to open or close in a harmonised manner, that is, that after sending a door opening order, the door opening order is transmitted to the paired door, either a train 2 or platform 3 door as applicable.

Figure 1B:
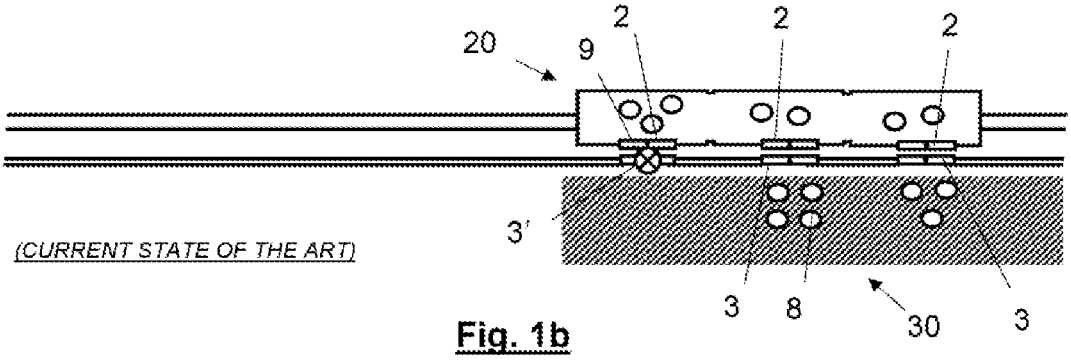

As may be seen in FIG. 1*b*, when the train 20 stops at the platform 30, a door of a train 20 is aligned with the corresponding paired door of a platform 30 thereof, such that, either automatically or manually by actuating a button for this purpose, the different pairs of train 2 and platform 3 doors are opened.

Figure 1C:
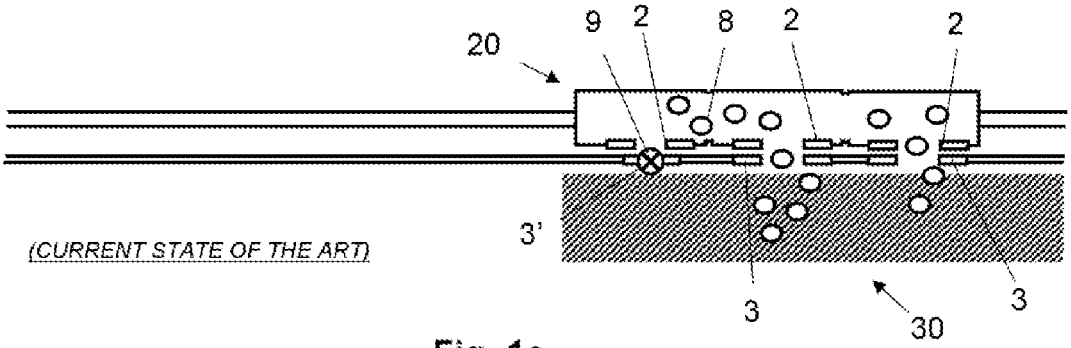

However, as can be seen in FIG. 1*c*, when a door has been disabled, usually by an operator if it does not work properly, such as the disabled platform door 3', the paired train door 2 thereof can open, but entry to and exit from the train cannot be created, meaning that the passengers 8 waiting to get on or off the train 20 must move to the adjacent pair of train 2 and platform 3 doors in order to get on or off the train 20, causing an accumulation of passengers 8 and bottlenecks that delay the departure of the train 20. Therefore, although the passengers 8 of the platform 30 can be warned by means of warning means 9 that the door will not open, the passengers 8 of the train 20 do not know said situation and can even be injured if they do not realise that the disabled platform door 3' is not open.

Figure 2:
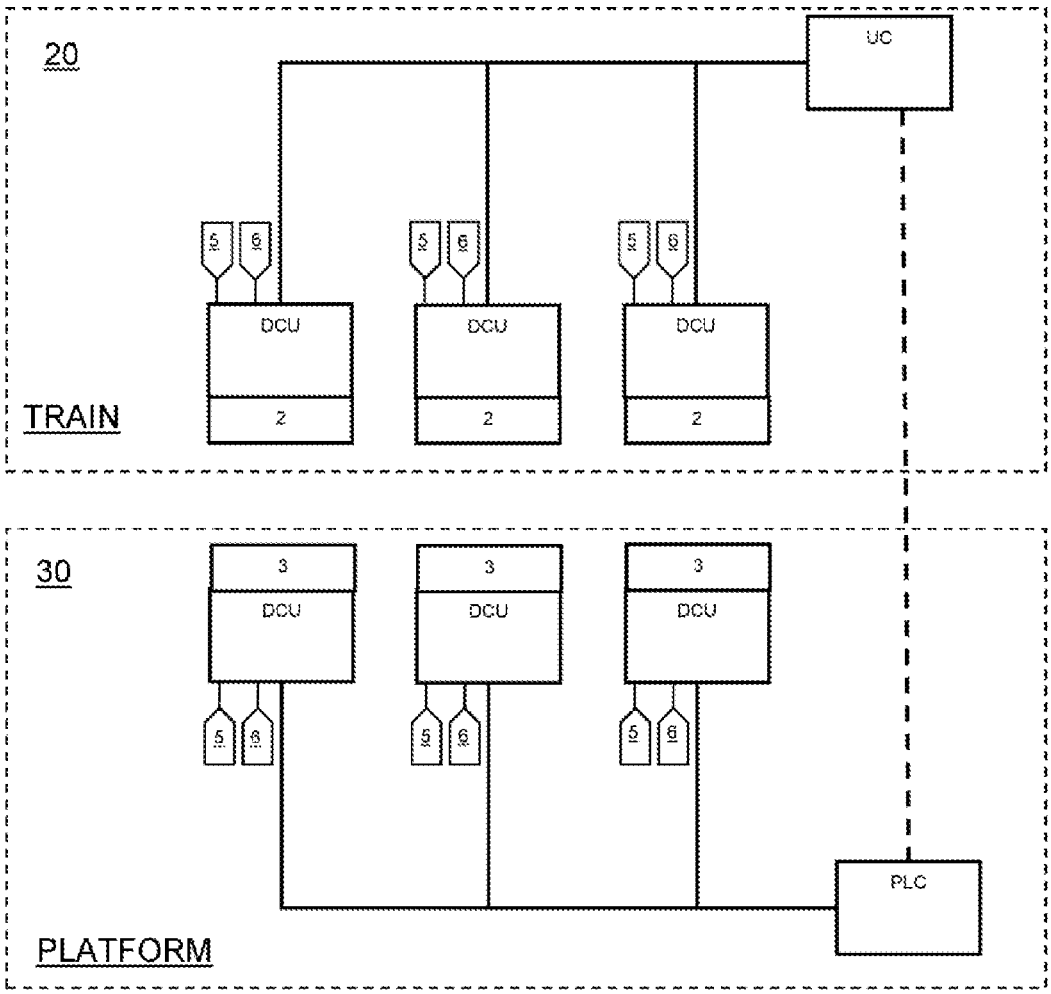
FIG. 2 shows a diagram of the door harmonisation system of the state of the art.

FIG. 2 schematically illustrates the connection system of the train 2 and platform 3 doors of the train 20 and platform 30 shown above in FIGS. 1*a* to 1*c*. In this FIG. 2, it can be seen that each train door 2 and each platform 3 door is connected to a respective door control unit DCU, which accordingly actuates the motors of the doors 2, 3 in order to open or close the same. The door control units DCU of the train 20 are connected to a train control unit UC, while the door control units DCU of the platform 3 are connected to a platform control unit PLC, the train control unit UC and platform control unit PLC being interlinked in a known manner to notify the opening warning of each of the doors 2, 3 such that the opening of the paired doors 2, 3 can be harmonised. In this way, if a passenger 5 actuates a button to open a train door 2, said button, which is connected to the door control unit DCU of the train door 2, sends a door opening request signal ("open_pushbutton_1") to the door control unit DCU, which sends it to the train control unit UC, and the latter sends it to the platform control unit PLC which sends it to the door control unit DCU corresponding to the paired platform door 3. This process entails a delay that the system of the present invention also solves. In addition to the corresponding delay, if the door control unit DCU is disabled, the harmonisation of the operating status of the pair of doors will fail.

In a known manner, the train 20 is provided with a train control unit UC, and the platform 30 is provided with a platform control unit PLC, prepared to send door opening signals ("open_command_1") and door enabling signals ("door_enable_1") from the respective doors thereof, each door being linked to door opening request means (5), prepared to send a door opening request signal ("open_pushbutton_1") and door isolating means (6), prepared to send a door isolating signal ("door_isolate_1"). The train 2 and platform 3 doors are connected to respective door control units DCU prepared to receive an opening signal ("open_door_2") to open the door, an enabling signal ("door_enable_2") to enable the door, and a isolating signal ("door_isolate_2") to isolate the door thus disabling it, which trigger the opening of the door 2, 3 when the opening signal indicates opening the door, the enabling signal indicates enabling the door and the isolating signal indicates not disabling the door.

Figure 3:
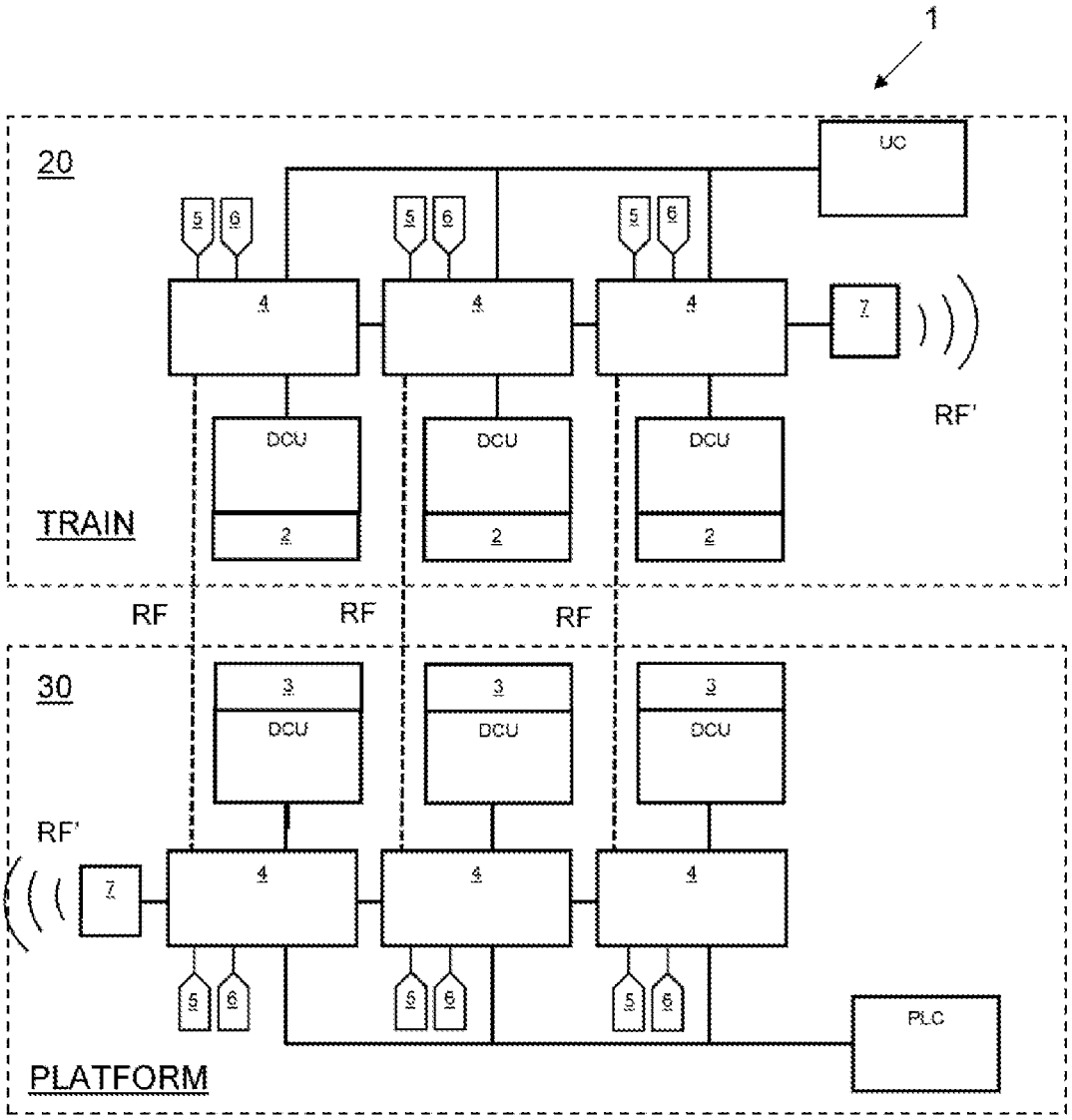
FIG. 3 shows a door harmonisation system of the invention.

Advantageously, as illustrated in FIG. 3, the system 1 of the present invention comprises pairs of adapter devices 4, each connected between a respective train control unit UC or platform control unit PLC and a respective door control unit DCU for paired doors. As can be seen, the adapter devices 4 are connected to a respective train control unit UC or platform control unit PLC, and are prepared to receive at least the door opening signal ("open_command_1"). They are also connected to the door opening request means 5 to receive the door opening request signal ("open_pushbutton_1") and to the door isolating means 6 to receive the door isolating signal ("door_isolate_1"). For a better understanding, FIGS. 2 and 3 only represent the data buses between the different elements, without indicating the signals that are transmitted through the data buses that shall be described in detail below. In this case, it is also envisaged that the train 20 is provided with the train control unit UC, and the platform 30 is provided with the platform control unit PLC, prepared to send door opening signals ("open_command_1") and door enabling signals ("door_enable_1") from the respective doors thereof, each door being linked to door opening request means (5), prepared to send a door opening request signal ("open_pushbutton_1") and door isolating means (6), prepared to send a door isolating signal ("door_isolate_1"). The train 2 and platform 3 doors are likewise connected to respective door control units DCU prepared to receive an opening signal ("open_door_2") to open the door, an enabling signal ("door_enable_2") to enable the door, and an isolating signal ("door_isolate_2") to isolate the door thus disabling it, which trigger the opening of the door 2, 3 when the opening signal indicates opening the door, the enabling signal indicates enabling the door and the isolating signal indicates not disabling the door.

The adapter devices 4 of each pair of adapter devices 4 are connected one between the train control unit (UC) and the respective door control unit (DCU), and another between the platform control unit (PLC) and the respective door control unit DCU, prepared to receive at least the door opening signal ("open_command_1"); the door opening request signal ("open_pushbutton_1"); and the door isolating signal ("door_isolate_1"); and to exchange between the adapter devices of the pair of adapter devices at least one paired door opening notification signal ("paired_open") after the receipt of a door opening signal ("open_command_1") or door opening request signal ("open_pushbutton_1") that indicates opening the door; and a paired door isolating notification signal ("paired_status") after the receipt of a door isolating signal ("door_isolate_1") that indicates isolating the door.

In this way and as shall be seen in greater detail below, the adapter devices 4 are prepared to trigger the harmonised opening of the paired doors by means of sending to the corresponding door control unit DCU the opening signal ("open_door_2") to open the door and the enabling signal ("door_enable_2") to enable the door, and/or the isolating signal ("door_isolate_2") to not isolate the door when at least one from among the door opening signal ("open_command_1"), the door opening request signal ("open_pushbutton_1") or the paired door opening notification signal ("paired_open") indicates opening the door, and the door isolating signal ("door_isolate_1") and the paired door isolating notification signal ("paired_status") indicate not isolating the door.

The paired door adapter devices 4 are also provided with point-to-point communication means RF to exchange at least the paired door opening notification signal ("paired_open") after the receipt of a door opening ("open_command_1") or door opening request signal ("open_pushbutton_1") that indicates opening the door; and the paired door isolating notification signal ("paired_status") after the receipt of a door isolating signal ("door_isolate_1") that indicates isolating the door.

As may be seen, the adapter devices 4 are also connected to a respective door control unit DCU for paired doors and are prepared to trigger the harmonised opening of the paired doors by means of sending to the corresponding door control unit DCU thereof the opening signal ("open_door_2") to open the door and the enabling signal ("door_enable_2") to enable the door, and, alternatively or additionally, the isolating signal ("door_isolate_2") to not isolate the door when at least one from among the door opening signal ("open_command_1"), the door opening request signal ("open_pushbutton_1") or the paired door opening notification signal ("paired_open") indicates opening the door, and the door isolating signal ("door_isolate_1") and the paired door isolating notification signal ("paired_status") indicate not isolating the door. Different embodiments of this method are described in detail below based on the logic circuits that describe, by way of example, operation modes of the adapter devices 4. Naturally, in addition to the embodiments described, other embodiments can be implemented that entail the same functionality and that would likewise form part of the invention.

Preferably, the pair of adapter devices 4 generate and send to the respective door control unit DCU thereof the same opening signals ("open_door_2") and enabling signals ("door_enable_2") or isolating signals ("door_isolate_2"), thus harmonising the operating status and opening of both paired doors, that is, that both paired doors only open when an opening request is made in one of them and none of them has been isolated.

Naturally, although pairs of train and platform doors are described, the present system could be used for other elements paired between the train and platform, such as another type of door, walkway, barrier, etc. such that the operating status is perfectly harmonised in a way similar to that described for the presented train 2 and platform 3 doors.

In addition, as can be seen in FIG. 3, the system 1 comprises two connection nodes 7, one arranged on the train 20 and the other on the platform 30, which centralise the status of the isolating means 6 of the train 2 and platform 3 doors, respectively, both connection nodes 7 being prepared to exchange, by means of communication means between nodes RF', the status of the isolating means 6 of the train doors 2 and the platform doors 3 that the adapter devices 4 collect, before the train 20 reaches the platform 30, and thus send an early isolating signal to the paired door adapter devices 4 to isolate the door when the paired door isolating means 6 indicate isolating the door. It is estimated that the frequency band in which the communication means between nodes RF' operate is in the 863 to 870 MHz band, although it is envisaged that any other available radio frequency band can be used.

By means of said connection nodes 7, it can be known, before the arrival of the train 20 to the platform 30, the doors 2, 3 that are out of service, that is, the isolating means 6 thereof indicate isolating the door, and in this way not only harmonise the enabling of paired doors, but also advantageously warn passengers 8 sufficiently in advance that a door will not open, since the paired door thereof is disabled. In this way, it is advantageously achieved that the passengers 8 distribute themselves beforehand over the rest of the doors that will open. It is envisaged that the use of the connection nodes 7 to exchange the status of the isolating means 6 of the train doors and platform doors can even be used independently from the system to harmonise the opening of the doors. In order to exchange as quickly as possible the status of the isolating means 6 of the train doors 2 and the platform doors 3, it is envisaged that each connection node 7 is preferably arranged adjacent to one end of the train 20 and the platform 30.

Naturally, it is envisaged that each door has elements or screens linked, by way of warning means 9, which enable the passengers 8 to be suitably warned about whether the door will be operational or not at the following station, that is, if the doors will be enabled for the opening thereof when the train reaches the platform, as well as being provided with buttons by way of door opening request means 5, which can be actuated by the passengers 8, as well as door isolating means 6, which preferably can be actuated by an operator to disable not only this door, but advantageously all the doors that can be paired with this door.

Figure 4:
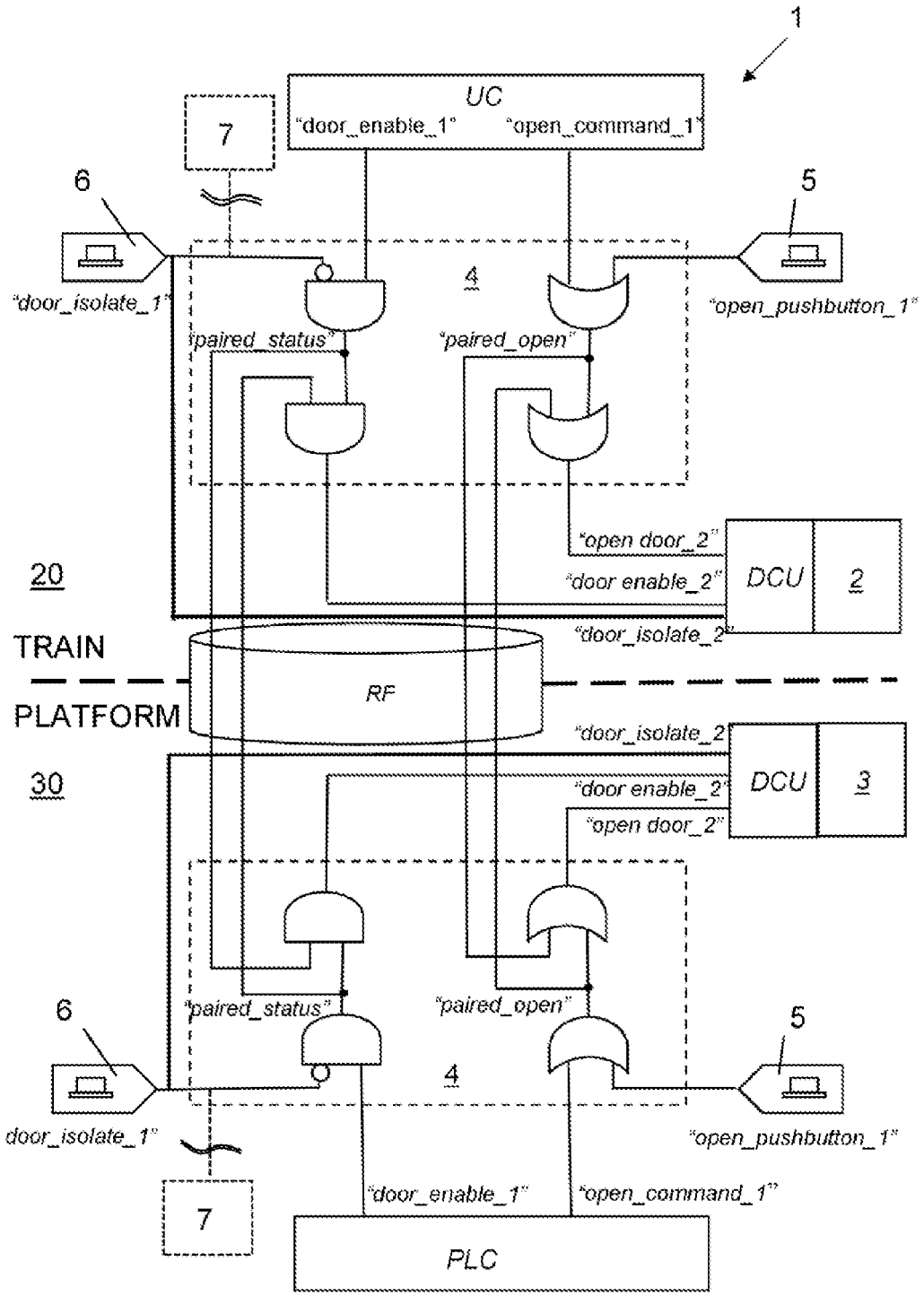
FIG. 4 shows a logic diagram of the door harmonisation system according to the invention.

In order to present in a more detailed manner how the information between adapter devices 4 are combined, FIG. 4 shows a logic diagram of communication between a pair of adapter devices 4, each one connected to a door control unit DCU of a train door 2 and to a door control unit DCU of a paired platform door 3.

As may be seen in FIG. 4, each adapter device 4 of a pair of paired door adapter devices 4 are connected between the respective train control unit UC or platform control unit PLC thereof and the respective door control unit DCU thereof. Each adapter device 4 is adapted to receive the door opening signal ("open_command_1") and the door enabling signal ("door_enable_1") from the respective train control unit UC or platform PLC control unit. It can also be seen that each adapter device 4 is adapted to receive the door opening request signal ("open_pushbutton_1") from the door opening request means 5 and the door isolating signal ("door_isolate_1") from the door isolating means 6.

In addition, each adapter device 4 is adapted to notify the other adapter device 4 of the pair of adapter devices of the receipt of a door opening signal ("open_command_1") or door opening request signal ("open_pushbutton_1") that indicates opening the door; and the door enabling signal ("door_enable_1") that indicates not enabling the door or the receipt of a door isolating signal ("door_isolate_1") that indicates sealing the door; each adapter device of the pair of adapter devices being prepared to generate and send to the respective door control unit DCU thereof, the opening signal ("open_door_2") and at least one from among the enabling signal ("door_enable_2") or the isolating signal ("door_isolate_2") to trigger the opening of the door when at least one from among the door opening signal, the door opening request signal, the paired door opening signal or the paired door opening request signal indicates opening the door, and the door enabling signal, the door isolating signal, the paired door enabling signal and the door isolating signal indicates enabling and not isolating the door, thus harmonising the opening of both paired train 2 and platform 3 doors.

The logic diagram shown in FIG. 4 schematically shows the different logic inputs and outputs of each adapter element 4, the value of these logic inputs and outputs being able to be logic "1" when they are activated and logic "0" when they are deactivated. Naturally, an expert can implement these logic elements in several ways, for example, suitably varying the voltages of the different communication lines and even multiplexing the signals in a signal communication line. It is also envisaged that a person skilled in the art can suitably modify this logic diagram, adapting it to the requirements of the system, for example, when the inputs and outputs are inverted, that is, negated. It is also envisaged that the logic circuit is carried out by means of other electronic devices, such as hardware devices such as processor and memory assemblies, in a manner known by a person skilled in the art, which carry out a similar function. However, the functionality has been represented by means of a circuit of logic doors that facilitates the understanding of the invention.

Moreover, as can be seen, the paired door adapter devices 4 are provided with communication means RF to exchange and notify the other adapter device of the pair of paired door adapter devices of the receipt of a door opening signal or door opening request signal that indicates opening the door; and the receipt of a door enabling signal that indicates not enabling the door or the receipt of a door isolating signal that indicates isolating the door.

In this way, as can be deduced from the set of logic gates shown in FIG. 4, it means that the paired train 2 and platform 3 doors can be opened when any door opening signal ("open_command_1") or door opening request signal ("open_pushbutton_1") is activated, as long as any door enabling signal ("door_enable_1") or door isolating signal ("door_isolate_1") is activated, such that any sent door opening signal or opening request signal acts globally on both paired doors provided that no enabling or isolating signal of the pair of doors indicates not enabling or isolating the door, thus harmonising the opening and enabling of both paired doors.

As can be seen, the adapter device 4 is provided with an input connected to door opening request means 5, such as a button, to generate the door opening request signal ("open_pushbutton_1"), the adapter device 4 being adapted to notify the receipt of this door opening order signal ("open_pushbutton_1") to the paired adapter device 4 thereof by means of communication means RF, such that not only is the operating status of the pair of doors 2, 3 harmonised, but the transmission time is also considerably reduced by means of the point-to-point connection. It is estimated that the frequency band in which the communication means RF operate is in the 863 to 870 MHz band, although it is envisaged that any other band can be used. In this way, it means that the opening or opening request signal is propagated to the paired door.

Moreover, the adapter device 4 is also provided with an input connected to isolating means 6 of the door that generate the door isolating signal ("door_isolate_1"), the adapter device 4 being prepared to notify the receipt of this isolating signal ("door_isolate_1") to the paired adapter device 4 thereof by means of communication means RF, such that if one of the doors is isolated by means of the isolating means 6, this isolating signal is propagated to the paired door. It is envisaged that the communication means RF of the paired adapter devices 4 are facing each other and enable communication between them when the doors are aligned when the train stops at the platform. Naturally, although it is envisaged that the communication means RF comprise point-to-point radio frequency communication means, it is also envisaged that the communication means can be any other type, for example, optical, enabling communication between them when the paired doors are aligned when the train stops at the platform.

As can be seen, the adapter devices 4 are prepared to combine the door opening signal ("open_command_1") and the door opening request signal ("open_pushbutton_1") and send to the other device the paired door opening notification signal ("paired_open"), that indicates opening the door when at least one of the door opening signal ("open_command_1") or door opening request signal ("open_pushbutton_1") indicates opening the door.

In addition, the adapter devices 4 are prepared to combine the door opening signal ("open_command_1"), the door opening request signal ("open_pushbutton_1"), and the paired door opening notification signal ("paired_open") from the other adapter device to generate the opening signal ("open_door_2") that indicates, to the respective door control unit (DCU), opening the door when at least one of the door opening or paired door opening signals ("paired_open") indicates opening the door.

As can also be seen, in order to notify the other adapter device 4 of the pair of adapter devices 4 of the receipt of a door enabling signal that indicates not enabling the door or the receipt of a door isolating signal that indicates isolating the door, the adapter devices 4 combine the door enabling signal ("door_enable_1") with the door isolating signal ("door_isolate_1") to generate and send to the other device a paired door non-enabling or isolating notification signal ("paired_status") to the other adapter device of the pair of adapter devices, that indicates not enabling the door when the door enabling signal ("door_enable_1") indicates not enabling the door and isolating the door when the door isolating signal ("door_isolate_1") indicates isolating the door.

In order to exchange the notification of the receipt of at least one door enabling signal that indicates not enabling the door or the receipt of a door isolating signal that indicates isolating the door, the adapter devices 4 combine the door enabling signal ("door_enable_1") and/or the door isolating signal ("door_isolate_1") with the paired door non-enabling or isolating notification signal ("paired_status") of the other adapter device to generate the enabling signal ("door_enable_2") and/or isolating signal ("door_isolate_2") that indicates, to the respective door control unit DCU, not enabling or isolating the door when at least one of the door enabling or isolating or paired door signals indicate not enabling or isolating the door.

It can be seen in FIG. 4 how the respective door control units DCU for controlling the train 2 and platform 3 doors continue to provide the opening signal ("open_door_2"), enabling signal ("door_enable_2") and isolating signal ("door_isolate_2") used in the known systems, the adapter devices 4 being implemented transparently and independently from the natural operation of the door control units DCU.

Moreover, it is additionally envisaged, indicated by means of the dashed line, that the adapter devices 4 can send the status of the isolating means 6 to the respective connection nodes thereof and receive the isolating status of the isolating means 6 of the paired door through the connection nodes 7, such that an early isolating signal is received that enables a warning to be provided before the train arrives at the station that the door will not open. Naturally, this early isolating signal must be suitably processed, for example, by substituting the isolating signal.

Figure 5:
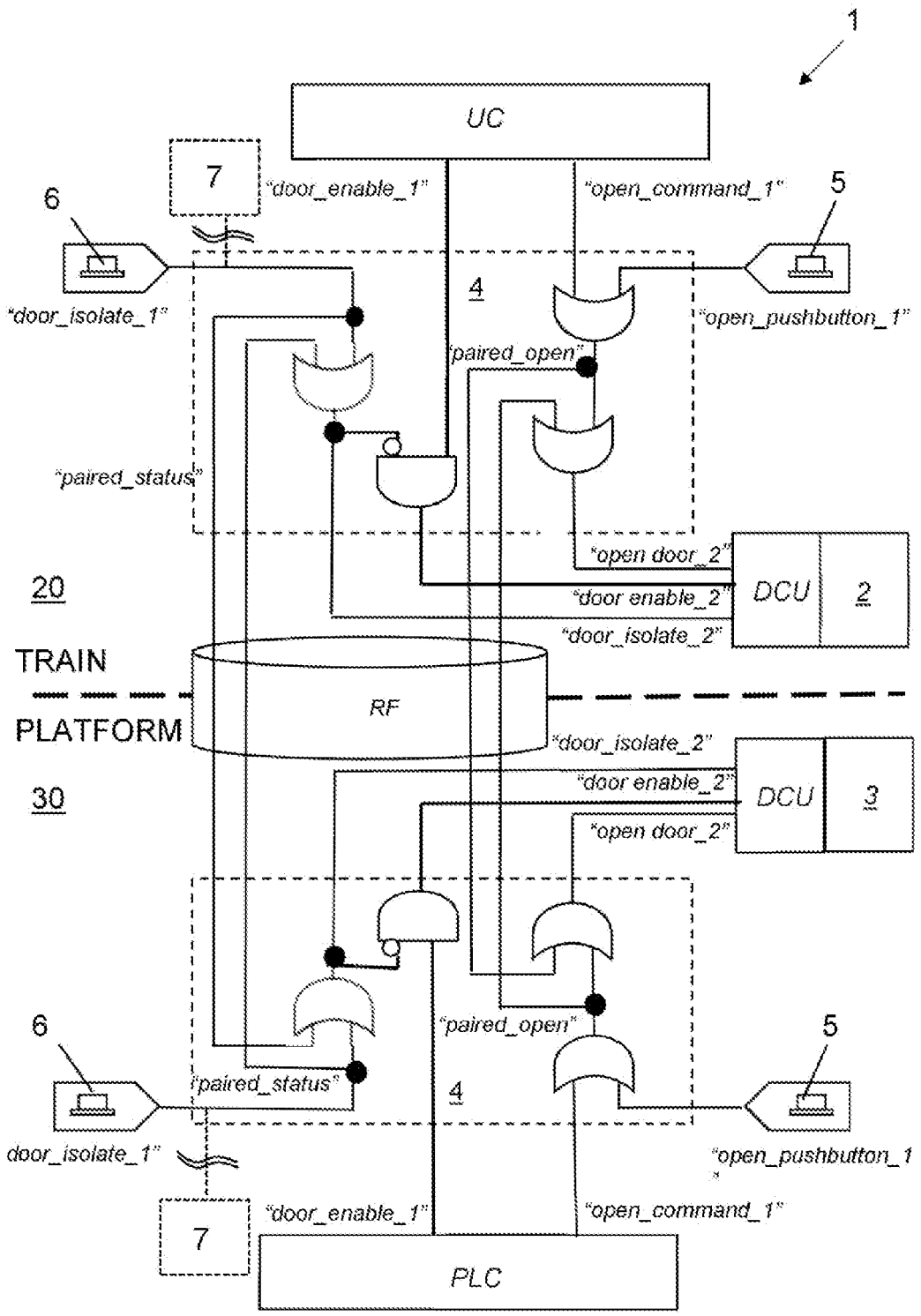
FIG. 5 shows another logic diagram of the door harmonisation system according to the invention.

FIG. 5 shows an alternative logic diagram to the one shown previously in FIG. 4, wherein the different logic inputs and outputs of each adapter element 4 is schematically shown, the value of these logic inputs and outputs being able to be logic "1" when they are activated and logic "0" when they are deactivated. Naturally, a person skilled in the art can implement these logic elements in many other ways or variants according to the present invention. It is also additionally envisaged that the adapter devices 4 can send the status of the isolating means 6 to the respective connection nodes thereof and receive the isolating status of the isolating means 6 of the paired door through the connection nodes 7.

Figure 6A:
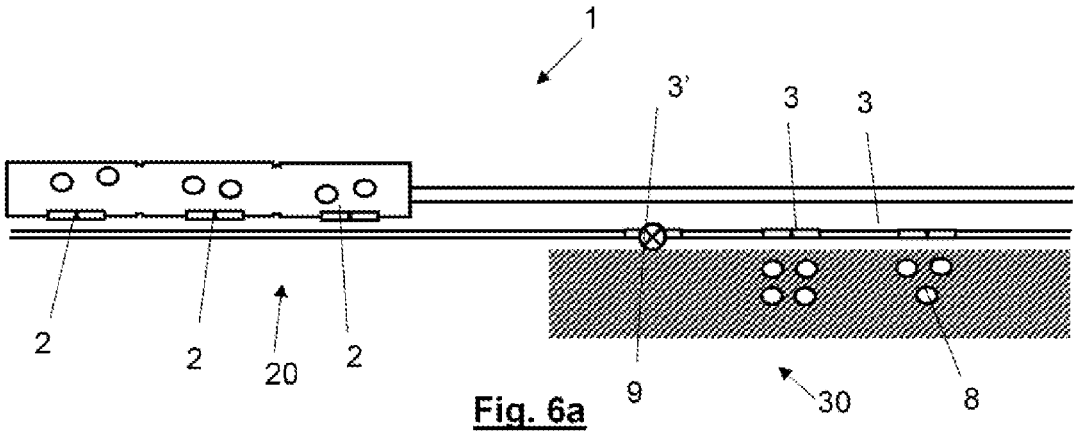
FIGS. 6*a* to 6*c* show a sequence of the arrival of a train to a platform, which has a service fault of a door, with a door harmonisation system according to the present invention.
Figure 6B:
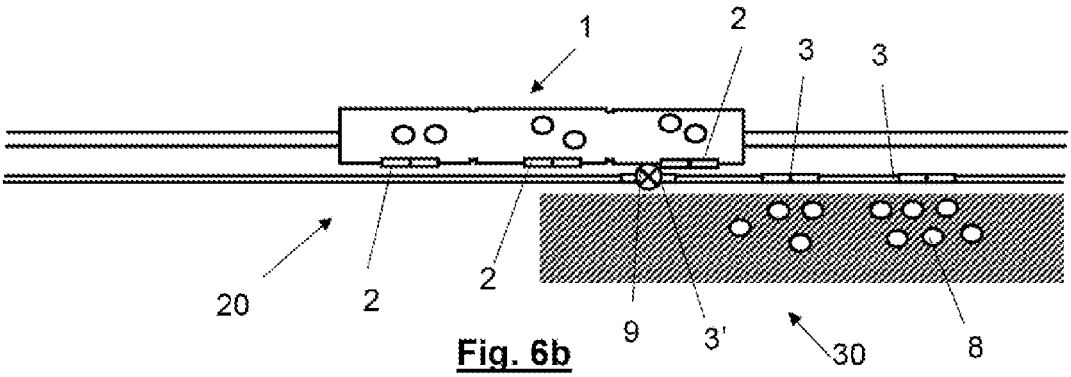
Figure 6C:
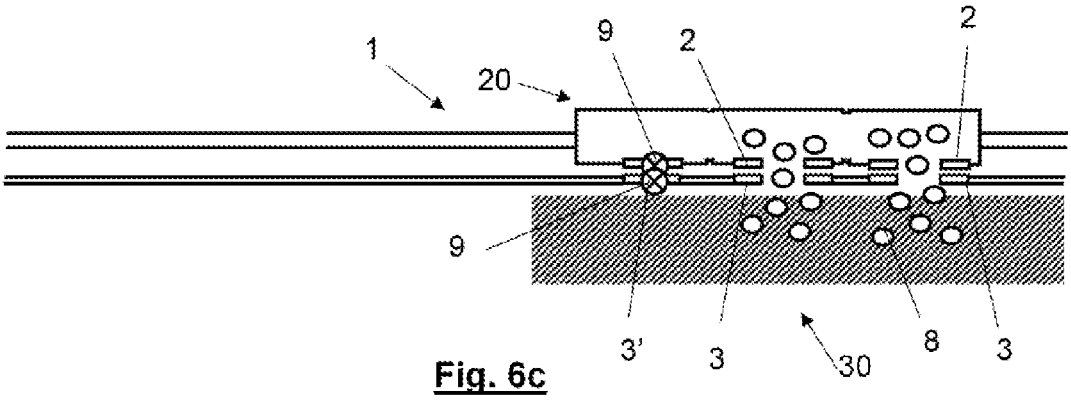

In this way, by means of the system 1 of the present invention, it means that the sequence illustrated above in FIGS. 1*a* to 1*c* can now be presented, in a first variant of an embodiment of the invention, devoid of connection nodes 7, as shown in FIGS. 6*a* to 6*c*. In the sequence of FIGS. 6*a* to 6*c*, it can be seen that when the train 20 moves closer to the platform 30, one of the platform doors is disabled 3', that is, the isolating means 6 thereof have been previously activated.

In this case, as seen in FIG. 6*c*, when the doors 2, 3 are aligned when the train 20 stops at the platform 30, the adapter device 4 linked to the disabled platform door 3' sends o the adapter device 4 linked to the paired train door 2 thereof, by means of the communication means (RF) thereof, a paired door isolating notification signal ("paired_status") after the receipt of a door isolating signal ("door_isolate_1") that indicates sealing the door. In this way, the adapter device 4 linked to the train door 2 thereof disables the train door 2, preferably by actuating warning means 9 informing passengers 8 that the train door 2 will not open, and also preventing the latter from opening.

The rest of the pairs of adapter devices 4 trigger the harmonised opening of the paired doors 2, 3 when at least one from among the door opening signal ("open_command_1"), the door opening request signal ("open_pushbutton_1") or the paired door opening notification signal ("paired_open") indicates opening the door, given that the door isolating signal ("door_isolate_1") and the paired door isolating notification signal ("paired_status") indicate not isolating the door.

Figure 7A:
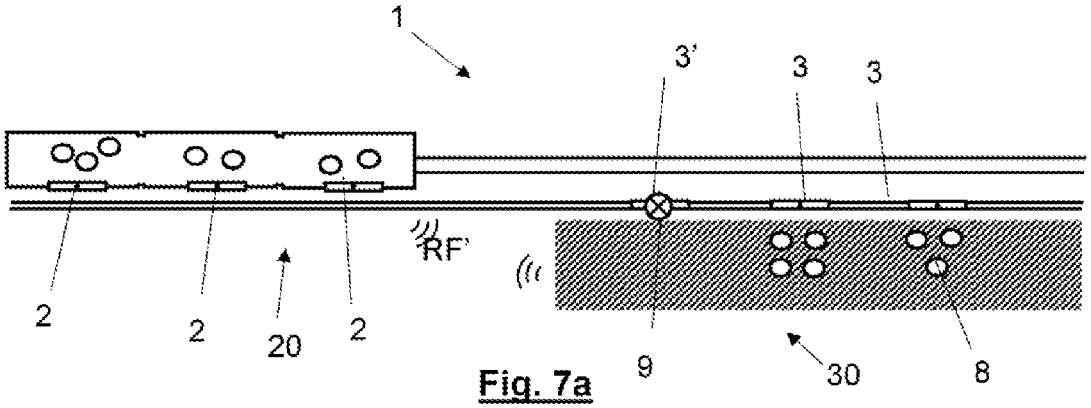
FIGS. 7*a* to 7*c* show the previous sequence of the arrival of the train at the platform with another door harmonisation system according to the present invention.
Figure 7B:
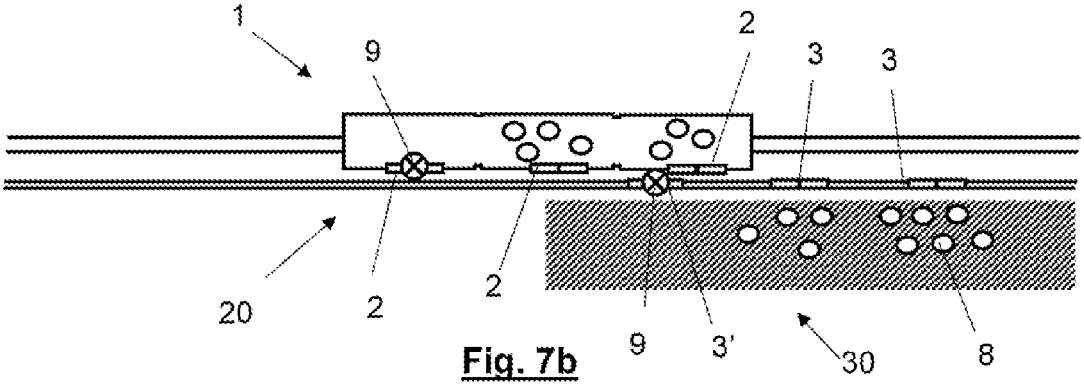
Figure 7C:
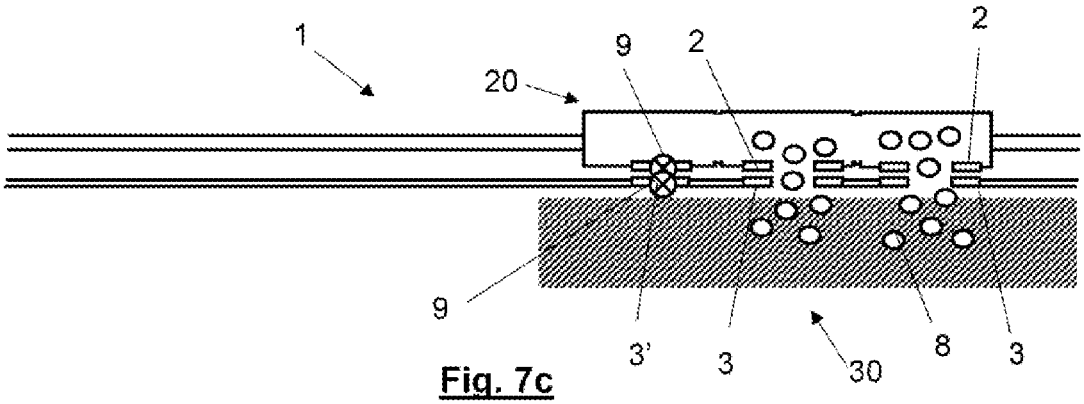

In addition, the sequence of FIGS. 7*a* to 7*c* further comprises two connection nodes 7, one being arranged on the train 20 and the other being arranged on the platform 30, which centralise the status of the isolating means 6 of the train 2 and platform 3 doors. In this way, as seen in FIG. 7*b*, an early isolating signal is sent to the adapter devices 4 of the door paired with the disabled platform door 3'. In this way, it can be known, before the arrival of the train 20 to the platform 30, that the train door 2 that is aligned with the disabled platform door 3' is out of service, and warn passengers 8 sufficiently in advance, for example by means of warning means 9, that a door will not open, since the paired door thereof is disabled. In this way, it is also achieved that the passengers 8 distribute themselves beforehand over the rest of the doors 2, 3 that will open. After the arrival of the train 20 at the platform 30, the doors are opened in a similar manner according to that which has been previously indicated for FIG. 6*c*.

The invention claimed is:

1. A system for harmonising operation of pairs of doors formed by a train door mounted on a train and a platform door mounted on a platform, the paired doors being adapted to be aligned when the train stops at the platform, the system comprising a train control unit (UC) adapted to be provided in the train, and a platform control unit (PLC) adapted to be provided in the platform, the train control unit (UC) and the platform control unit (PLC) being adapted to send door opening signals ("open_command_1") and door enabling signals ("door_enable_1") of the respective doors thereof;

each door being linked to:

door opening request means, adapted to send a door opening request signal ("open_pushbutton_1") and door isolating means, adapted to send a door isolating signal ("door_isolate_1");

the system further comprising respective door control units (DCU), each train and platform doors being connectable to a door control units (DCU), the door control unit (DCU) being adapted to receive an opening signal ("open_door_2") to open the door, an enabling signal ("door_enable_2") to enable the door, and an isolating signal ("door_isolate_2") to isolate the door thus disabling it, and trigger the opening of the door when the opening signal indicates opening the door, the enabling signal indicates enabling the door and the isolating signal indicates not disabling the door, and at least one pair of adapter devices, one adapter device of each pair of adapter devices being connected between the train control unit (UC) and the respective door control unit (DCU), and the other adapter device of each pair of adapter devices being connected between the platform control unit (PLC) and the respective door control unit (DCU), adapted to receive, at least:

the door opening signal ("open_command_1")

the door opening request signal ("open_pushbutton_1");

the door isolating signal ("door_isolate_1");

and to exchange between the adapter devices of the pair of adapter devices, at least:

one paired door opening notification signal ("paired_open") after the receipt of a door opening signal ("open_command_1") or door opening request signal ("open_pushbutton_1") that indicates opening the door; and one paired door isolating notification signal ("paired_status") after the receipt of a door isolating signal ("door_isolate_1") that indicates isolating the door; wherein the adapter devices trigger the harmonised opening of the paired doors by sending, to the door control unit (DCU) connected to the adapter devices, the opening signal ("open_door_2") to open the door and the enabling signal ("door_enable_2") to enable the door, and/or the isolating signal ("door_isolate_2") to not isolate the door when:

at least one from among the door opening signal ("open_command_1"), the door opening request signal ("open_pushbutton_1") or the paired door opening notification signal ("paired_open") indicates opening the door, and the door isolating signal ("door_isolate_1") and the paired door isolating notification signal ("paired_status") indicate not isolating the door;

and the paired door adapter devices are further provided with communication means (RF) to exchange paired door opening notification signals ("paired_open") and paired door isolating notification signals ("paired_status").

2. The system according to claim 1, characterised in that the each adapter device of each pair of adapter devices are adapted to combine the door opening signal ("open_command_1") and the door opening request signal ("open_pushbutton_1") and send to the other adapter device of each pair of adapter devices the paired door opening notification signal ("paired_open"), that indicates opening the door when at least one of the door opening signal ("open_command_1") or door opening request signal ("open_pushbutton_1") indicates opening the door.

3. The system according to claim 2, characterised in that each adapter device is adapted to combine the door opening signal ("open_command_1"), the door opening request signal ("open_pushbutton_1"), and the paired door opening notification signal ("paired_open") from the other adapter device to generate the opening signal ("open_door_2") that indicates, to the respective door control unit (DCU), opening the door when at least one of the door opening or paired door opening signals indicates opening the door.

4. The system according to claim 1, characterised in that the communication means (RF) comprise point-to-point communication means between paired door adapter devices.

5. The system according to claim 1, characterised in that the door opening request means comprise a button connected to an input of the adapter devices to generate the door opening request signal ("open_pushbutton_1").

6. The system according to claim 1, characterised in that the door isolating means comprise a locking mechanism connected to an input of the adapter devices to generate the door isolating signal ("door_isolate_1").

7. The system according to claim 1, characterised in that it further comprises two connection nodes, one arranged on the train and the other on the platform, which centralise the status of the isolating means of the train and platform doors, respectively, both connection nodes being adapted to exchange the status of the isolating means of the train doors and the platform doors before the train arrives at the platform, and send an early isolating signal to the paired door adapter devices to isolate the door when the paired door isolating means indicate isolating the door.

8. The system according to claim 7, characterised in that the connection nodes are respectively arranged adjacent to ends of the train and the platform.

9. A method for harmonising operation of pairs of doors formed by a train door mounted on a train and a platform door mounted on a platform, the paired doors being adapted to be aligned when the train stops at the platform, the train being provided with a train control unit (UC), and the platform being provided with a platform control unit (PLC) the train control unit (UC) and the platform control unit (PLC) being adapted to send door opening signals ("open_command_1") and door enabling signals ("door_enable_1") of the respective doors thereof;

each door being linked to:

door opening request means, adapted to send a door opening request signal ("open_pushbutton_1") and door isolating means, adapted to send a door isolating signal ("door_isolate_1");

the train and platform doors being connected to respective door control units (DCU) adapted to receive an opening signal ("open_door_2") to open the door, an enabling signal ("door_enable_2") to enable the door, and an isolating signal ("door_isolate_2") to isolate the door thus disabling it, the respective door control units (DCU) being configured to trigger the opening of the door when the opening signal indicates opening the door, the enabling signal indicates enabling the door and the isolating signal indicates not disabling the door, the method further comprising:

the step of receiving in each adapter device of at least one pair of adapter devices, one adapter device of each pair of adapter devices being connected between the train control unit (UC) and the respective door control unit (DCU), and the other adapter device of the each pair of adapter devices being connected between the platform control unit (PLC) and the respective door control unit (DCU), at least:

the door opening signal ("open_command_1")

the door opening request signal ("open_pushbutton_1");

the door isolating signal ("door_isolate_1");

the step of exchanging between the adapter devices of the pair of adapter devices, by means of communication means (RF), at least:

one paired door opening notification signal ("paired_open") after the receipt of a door opening signal ("open_command_1") or door opening request signal ("open_pushbutton_1") that indicates opening the door; and one paired door isolating notification signal ("paired_status") after the receipt of a door isolating signal ("door_isolate_1") that indicates isolating the door; and the step of the adapter devices triggering the harmonized opening of the pair doors by sending, to the door control unit (DCU) connected to the adapter devices, the opening signal ("open_door_2") to open the door, and the enabling signal ("door_enable_2") to enable the door, and/or the isolating signal ("door_isolate_2") to not isolate the door, when:

at least one from among the door opening signal ("open_command_1"), the door opening request signal ("open_pushbutton_1") or the paired door opening notification signal ("paired_open") indicates opening the door, and the door isolating signal ("door_isolate_1") and the paired door isolating notification signal ("paired_status") indicate not isolating the door.

10. The method according to claim 9, characterised in that the each adapter device of each pair of adapter devices carries out a step of combining the door opening signal ("open_command_1") and the door opening request signal ("open_pushbutton_1") and sending to the other adapter device of each pair of adapter devices the paired door opening notification signal ("paired_open"), that indicates opening the door when at least one of the door opening signal ("open_command_1") or door opening request signal ("open_pushbutton_1") indicates opening the door.

11. The method according to claim 10, characterised in that each adapter device of each pair of adapter devices carries out a step of combining the door opening signal ("open_command_1"), the door opening request signal ("open_pushbutton_1"), and the paired door opening notification signal ("paired_open") of the other adapter device of each pair of adapters devices to generate the opening signal ("open_door_2") that indicates, to the respective door control unit (DCU), opening the door when at least one of the door opening or paired door opening signals indicates opening the door.

* * * * *